United States Patent [19]

Hansen

[11] 4,060,275

[45] Nov. 29, 1977

[54] COLLAPSIBLE TABLE

[76] Inventor: M. James Hansen, 11348 SW. Ironwood Lp., Tigard, Oreg. 97223

[21] Appl. No.: 725,274

[22] Filed: Sept. 21, 1976

[51] Int. Cl.[2] ..... A47B 3/14

[52] U.S. Cl. ..... 297/159; 108/100; 108/132

[58] Field of Search ..... 297/159, 157; 108/131, 108/132, 99, 100, 101

[56] References Cited

U.S. PATENT DOCUMENTS

| | | | |
|---|---|---|---|
| 1,312,137 | 8/1919 | Schloss | 108/131 |
| 2,661,792 | 12/1953 | Lysaght | 108/99 X |
| 2,717,028 | 9/1955 | Villemure | 297/159 |
| 3,101,061 | 8/1963 | Amend | 108/101 |
| 3,475,053 | 10/1969 | Parker et al. | 297/157 |

FOREIGN PATENT DOCUMENTS

| | | | |
|---|---|---|---|
| 16,801 | 5/1898 | Switzerland | 108/132 |
| 598,527 | 2/1948 | United Kingdom | 297/159 |

*Primary Examiner*—Francis K. Zugel
*Attorney, Agent, or Firm*—Ralph L. Thomas

[57] ABSTRACT

This collapsible table has hinged legs, a hinged support for legs, and the benches are integral. This two-bench table is collapsible to a volume defined by the dimensions of the benches and the depth of such folded supports therefor. The table is sized for infants, juveniles, or families on up to army mess hall use.

1 Claim, 8 Drawing Figures

COLLAPSIBLE TABLE

BACKGROUND OF THE INVENTION

In tables generally referred to as picnic tables, or army mess hall tables, the material is usually wood. When such tables are not in use, such as during the winter for a picnic table, the tables are left exposed to the elements or are occupying space that could be otherwise utilized.

SUMMARY OF THE INVENTION

This invention is directed to a sturdy table which has, in its collapsed or storable condition, a pair of benches which are in the same plane as the surface of the top of the table, a leg support lies against the lower surface of such table top, and the legs are hinged thereto, leg pairs extend toward each other to provide a minimum storage volume. Each pair of legs has a support member which serves also as a leg support and a bench support. A center brace means is provided that presses outwardly on the central portion of the leg and bench support members to assure rigid assembly. This center brace means comprises a compression member to press against the said support members and two angularly disposed connecting members secured at each end of the compression member. The other ends of the angularly disposed connecting members are hinged to the inner side of the table top and are spaced apart from each other. The legs 12, 13, 14 and 15 are limited in their outward movement by the hinges 33.

In the assembled condition, the leg pairs are swung into substantially vertical positions, each pair has a bench support means and said bench support means, in turn, becomes a leg pair support means. The leg support means is swung into a substantially vertical position whereby rigidity is established. The integral unit which includes the benches and a connecting means at each end of said benches is lowered from the surface of the table to rest on the bench supports on the leg pairs, thereby establishing the rigid, ready-to-use, assembled table.

This collapsible capability provides a table which can be stored in a very small space relative to the space required for use of such table. Further, this affords easy transportation of the table. The table occupies far less storage and transport space with the obvious accompanying advantages. Also, since the table is readily movable, proper car for the table is enabled. No longer is it necessary for the table to be left in adverse conditions of climate nor occupy space otherwise usable when the table is not in use. Detent means can be provided to doubly assure that the leg support means maintain their proper position when assembled. Normally, the tight friction fit of the parts is sufficient for sturdy assembly.

It is an object of this invention to provide a bench type table with the capability of being stored in a space far smaller than the space occupied by the table in use.

It is a further object of this invention to provide a plurality of wooden bench type tables when folded to occupy less volume than a single, assembled table for transport or storage purposes.

A still further object of this invention is to provide a sturdy wooden bench type table that is readily and easily collapsible.

Other and further objects and advantages of the invention will become more evident from a consideration of the following specification when read in light of the annexed drawings.

DESCRIPTION OF THE PREFERRED EMBODIMENTS

Figure 1:
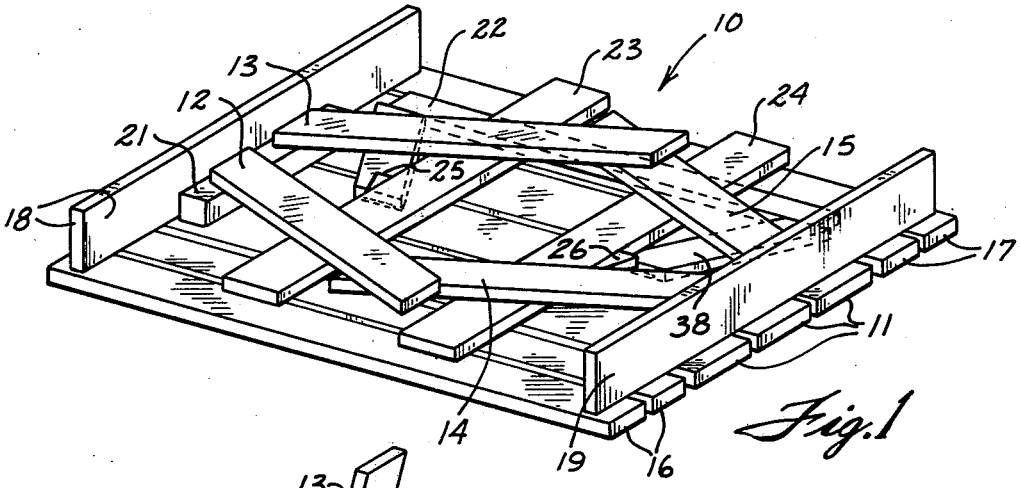
FIG. 1 is a pictorial view showing the table of this invention in collapsed or storage inverted condition.

FIG. 1 shows table 10 in folded condition as it would be when removed from storage or upon arrival after having been transported. The table top 11 is shown in a downward position to enable the table to be assembled. Leg pair 12 and 13 and leg pair 14 and 15 are shown in folded condition. Two benches 16 and 17 are shown with connecting cross members 18 and 19 at opposite ends of said benches. The connecting cross members 18 and 19 are not secured to top 11, they are secured only to benches 16 and 17 at the ends thereof. The boards of top 11 are secured to a cross member 21 and a second such cross member which is hidden behind cross member 19. Leg pair 12 and 13 are hinged to cross member 21. Leg pair 14 and 15 are hinged to the unseen cross member. A center brace member 22 is hinged to the bottom of the center board of top 11. The legs and the center brace are shown in their collapsed position, reducing the height of the table to the thickness of the top or the benches and the height of the bench support cross members 18 or 19. Leg pair 12 and 13 have a cross member 23 which provides two-dimensional rigidity to the legs. Likewise leg pair 14 and 15 have a cross member 24 giving similar limited rigidity. On cross member 23 can be a detent means 25 for limiting the movement of center brace 22. A similar detent means 26 can be on cross member 24 to doubly assure correct assembly and to provide further rigidity for the set-up table.

Figure 2:
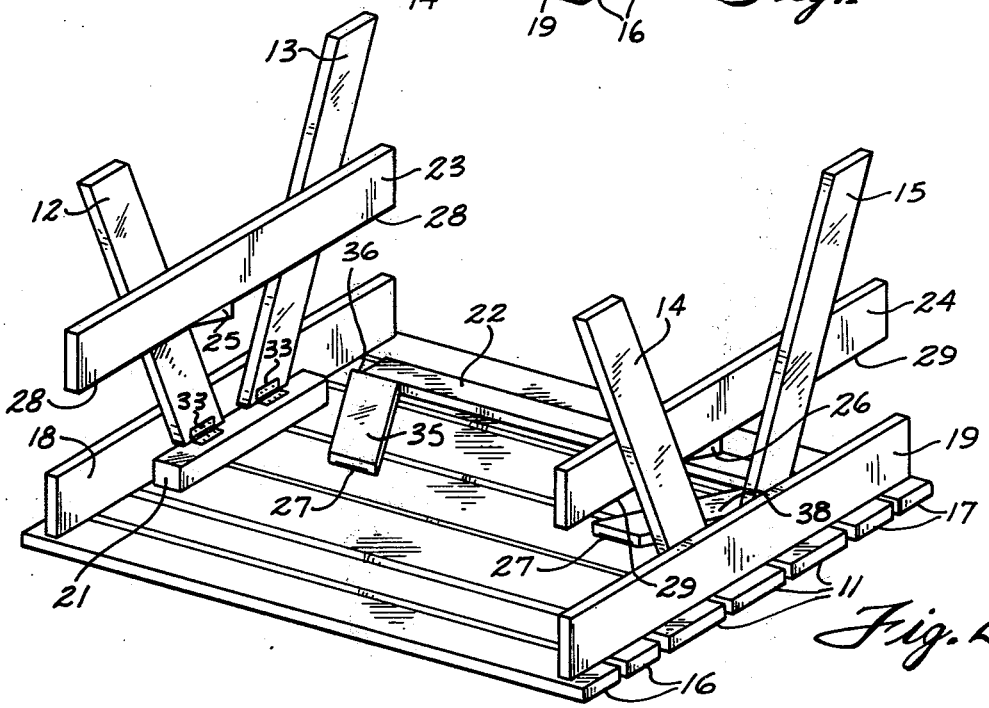
FIG. 2 shows the device of FIG. 1 with the leg pairs raised to a vertical position.

FIG. 2 shows the same view as FIG. 1 with the legs raised to their set-up position and the center brace still lying against the bottom of the top and the bottom of bench 17. Hinges 27 are provided to hinge the center brace 22 to the bottom of the center of top 11. On cross member 23 which secured leg pair 12 and 13 is a surface 28 which is directed toward the bottom of the benches 16 and 17. A similar surface 29 is provided on cross member 24. Cross member 24 provides leg pair 14 and 15 with two-dimensional rigidity. The top boards 11 of the table are secured by connecting members 21 at each end thereof. The leg pairs are secured to the top by use of hinges 33. Identical structure is utilized for the leg pair 14 and 15 as is shown for leg pair 12 and 13. Center brace member 22 has a connecting board 35 at one end thereof and board 36 at the other end thereof. These connecting boards 35 and 36 provide the dimension for the center brace that connects such center brace from the hinge pair 27 to be properly located against cross support members 23 and 24 respectively. Connecting board 35 is hinged to hinge 27 at one end and at the other is secured to one end of the center brace 22. A portion of the end of connecting board 35 which is secured to the center brace 22 extends beyond the end of such center brace 22 to form a ledge 36. When the end of center brace 22 is tightly engaged with connecting pieces 23 and 24 as in the assembled position of this table, the ledge 36 overlies the edge 28 of connecting member 23 and can be tight against detent means 25, to establish the third dimension of rigidity necessary for the satisfactory use of this table. A second connecting board 38 is hinged to a second hinge 27 at one end and at the other is secured to the other end of center brace 22. Board 38 can be provided with a ledge symmetrical with ledge 36 of board 35. Boards 35 and 38 are angularly disposed to provide support. Rigidity is thereby given to the center brace 22.

Figure 3:
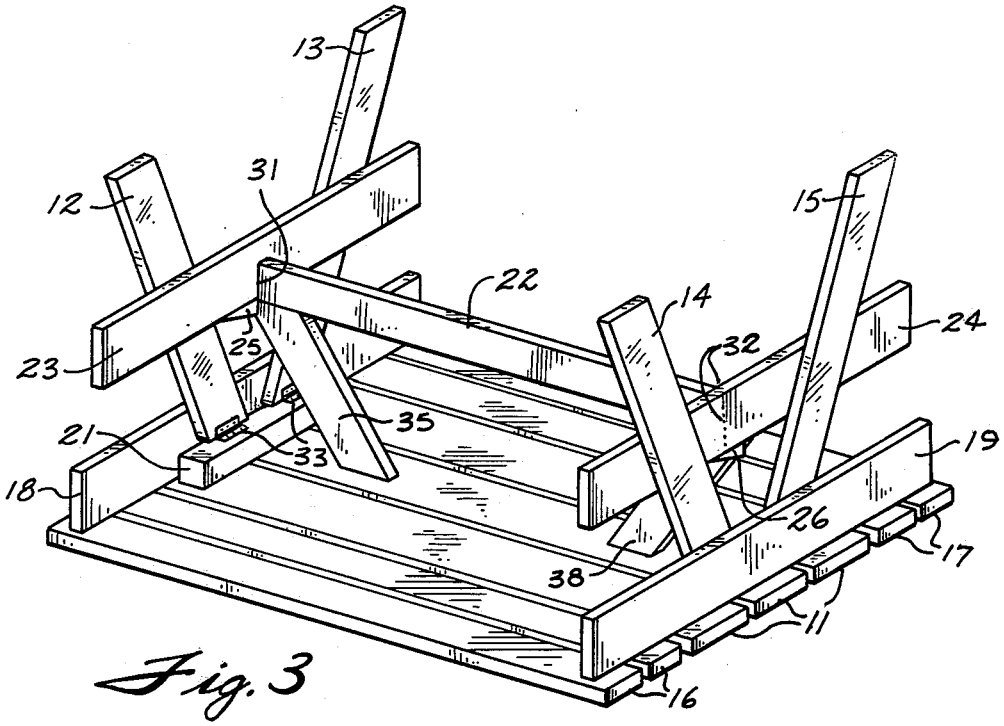
FIG. 3 shows the table of FIG. 2 with the leg support means swung into vertical position.

FIG. 3 shows the structure of FIG. 2 with the movement of the center brace 22 into position against detents 25 and 26 having been accomplished. Center brace 22 has two ends 31 and 32 which press against cross pieces 23 and 24 to establish the third dimension of rigidity. Leg pair 12 and 13 are confined by further outward movement by the hinges 33 which are secured to a member 21 to which the bottom of table top 11 is secured, or by the cross member 19 to which benches 16 and 17 are secured, or both the hinges and the cross pieces.

Figure 4:
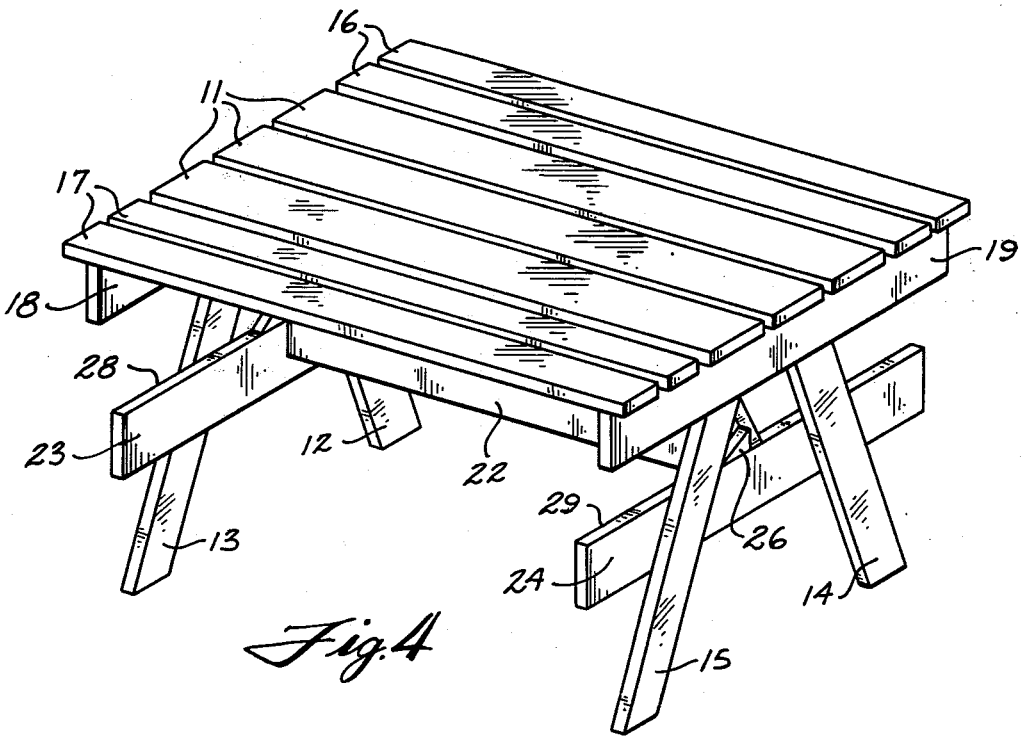
FIG. 4 shows the table in the condition shown in FIG. 3 rotated to be in proper position for use.

FIG. 4 shows the table in the same state of assembly as in FIG. 3 with the entire structure having been inverted, now in a position for use.

Figure 5:
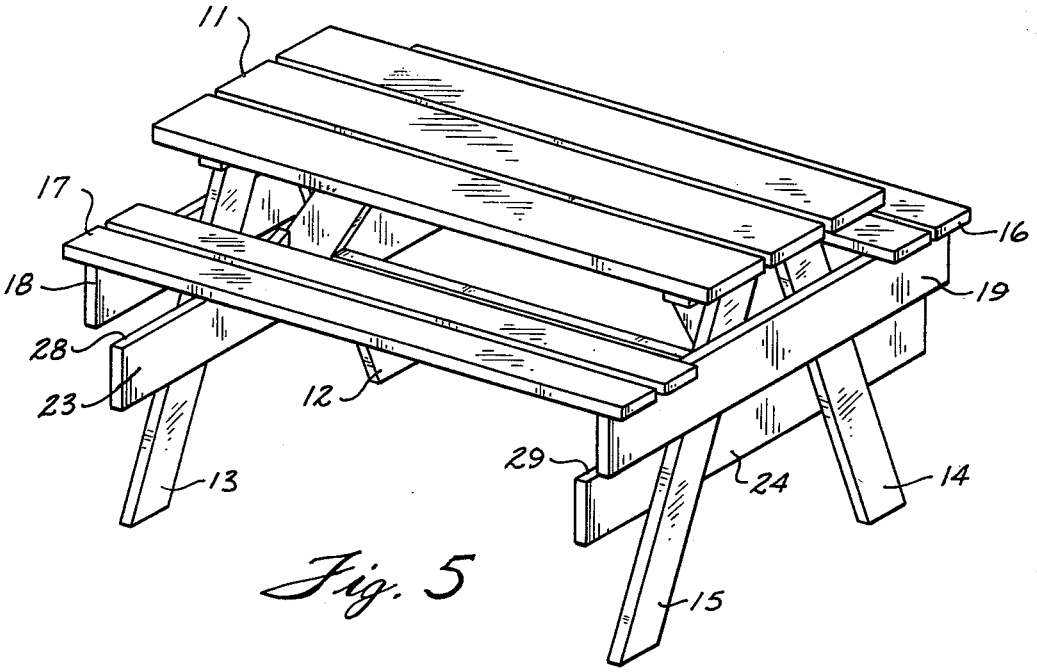
FIG. 5 shows the table of FIG. 4 with the benches partially lowered.

FIG. 5 shows the table of FIG. 4 with the bench assembly half way descending toward its usable position. The bench assembly includes bench 17, cross pieces 18 and 19, and bench 16.

Figure 6:
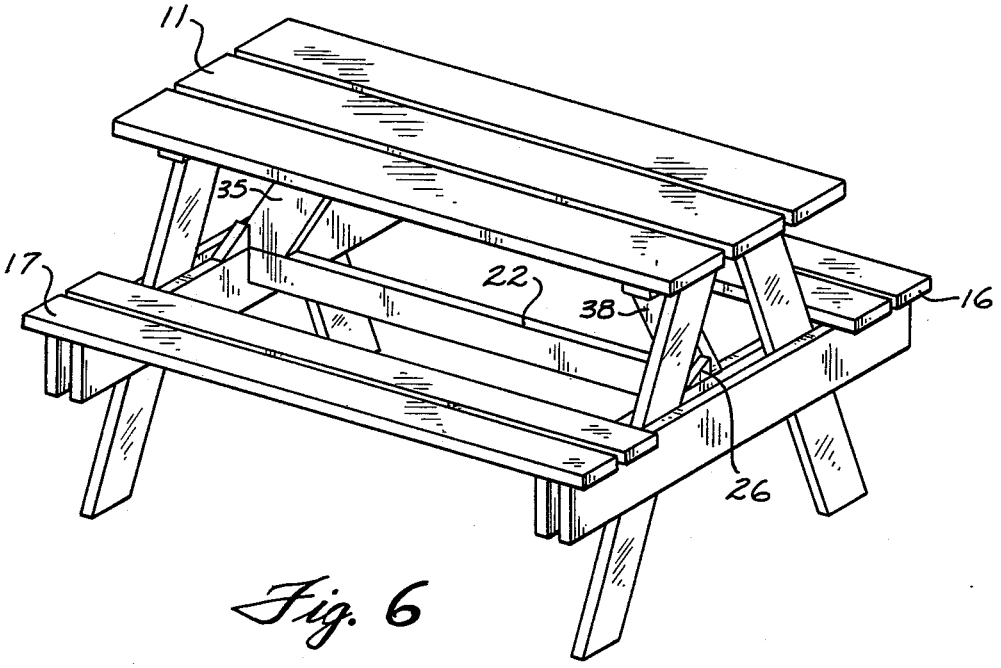
FIG. 6 shows the completely assembled table.

FIG. 6 shows the completely assembled, set-up table, ready for use.

Figure 7:
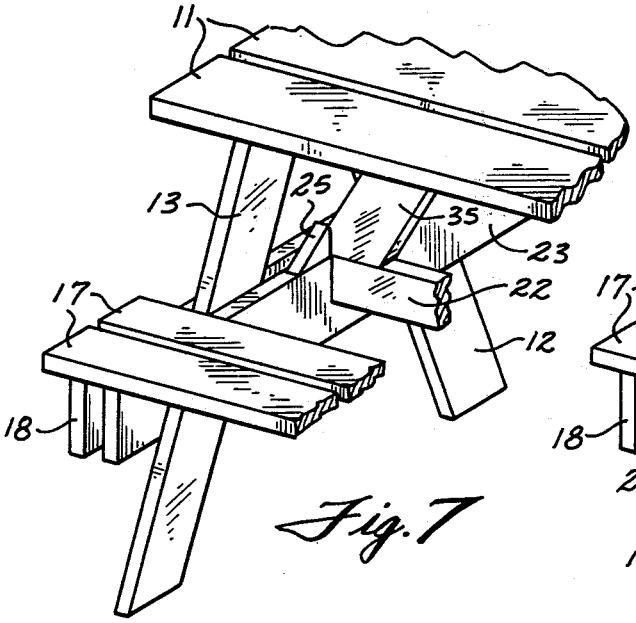
FIG. 7 shows a detent detail for the leg support.

FIG. 7 is a detailed showing of the detent 25 confining the surface area 36 of connecting member 35 therebehind.

Figure 8:
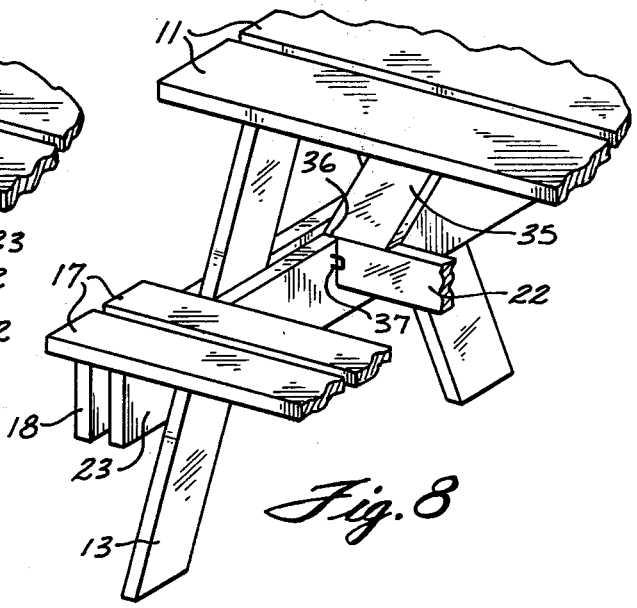
FIG. 8 shows a second embodiment of the detent for the leg support.

FIG. 8 is a showing of a second form of detent such as a staple or bolt, or the like, 37. The detent area 36 is more clearly shown in FIG. 8 since it is hidden by detent 25 in FIG. 7.

The fully assembled table as shown in FIG. 6 is readily usable as a very sturdy piece of furniture. The benches rest on the cross pieces and the legs are secured by the center brace. The top is rigid and has all the attributes of a table while providing the added feature of being collapsible for proper and easy storage and for far more satisfactory transportability.

It will be understood that various changes and modifications may be made in the above-described construction which provide the characteristics of the invention without departing from the spirit thereof particularly as described in the following claims.

What is claimed is:

1. In a table with foldable legs, a table top means, a first, second, third and fourth table leg means, a first and second leg attachment means, a first and second bench means, a first and second bench securing means, a first, second, third and fourth hinge means, brace means, a first and second cross member for securing a pair of said legs in planar relationship, for supporting said bench means, and for receiving said brace means, said first leg attachment means being secured to the underside of said top means at one end thereof, said second leg attachment means being secured to the other end of said underside of said top means, said first cross member secured to said first and said second leg means at a location determined by the desired height of said bench means and by the desired distance between said bench means and said table top means, said second cross member secured to said third and fourth leg means at a location determined in the same manner as was said first assembly means, said first and second leg means connected to said first leg attachment means by said first hinge means, said third and fourth leg means connected to said second leg attachment means by said second hinge means, said first bench securing means secured to one end of said pair of bench means, said second bench securing means secured to the other end of said pair of bench means, said bench securing means positioned inwardly of said top means edges so as to be confined by the underside of said top means and outwardly of said table leg means, said bench means secured to said bench securing means to form a unitary structure, said bench means and said top means forming substantially a single plane when the table is in the stored position, said brace means having a center brace means, a pair of connecting board means, a third and fourth hinge means, said third and fourth hinge means secured to the bottom of said table top means and spaced from each other, each of said connecting board means hinge connected at one end to one of said third and fourth hinge means and rigidly secured at the other end to said center brace means, said connecting board means forming an acute angle with respect to said center brace means, and said connecting means and said third and fourth hinge means permit said center brace means to lie parallel to the underside of said top means when stored and compressively to engage said cross members to position said table leg means against said bench securing means to provide rigidity to the set-up table.

* * * * *